United States Patent [19]

Redmond et al.

[11] 4,009,297

[45] Feb. 22, 1977

[54] GOLD DEPOSITION PROCEDURES AND SUBSTRATES UPON WHICH GOLD HAS BEEN DEPOSITED

[75] Inventors: John Peter Redmond, Mechanicsburg; Daniel Marshall Andrews; Karl Edward Guyler, both of Harrisburg, all of Pa.

[73] Assignee: AMP Incorporated, Harrisburg, Pa.

[22] Filed: Feb. 25, 1974

[21] Appl. No.: 553,047

[52] U.S. Cl. ..... 427/54; 427/252; 427/304

[51] Int. Cl.[2] ..... B05D 3/06; C23C 11/02

[58] Field of Search ..... 427/430, 437, 304, 305, 427/306, 404, 405, 54, 252; 260/430

[56] References Cited

UNITED STATES PATENTS

| | | | |
|---|---|---|---|
| 3,440,113 | 4/1969 | Wolley | 427/252 |
| 3,537,878 | 11/1970 | Baudrand et al. | 427/304 |
| 3,567,488 | 3/1971 | Rathsack | 427/304 |
| 3,661,959 | 5/1972 | Vaughan | 260/430 |

OTHER PUBLICATIONS

Kowala et al., "Australia J. Chem.", 1966, vol. 19, pp. 539–559.

*Primary Examiner*—John H. Newsome
*Attorney, Agent, or Firm*—Russell J. Egan

[57] ABSTRACT

A method for electroless gold plating in which gold ligand complexes are used; a photolytic method for depositing catalytic amounts of gold on a substrate suitable for an electroless metal deposition method whereby the gold complexes used are trivalent gold complex; a method for immersion plating or vaporization plating of gold from complexes, and complexes for the above methods.

33 Claims, 6 Drawing Figures

Figure 1:
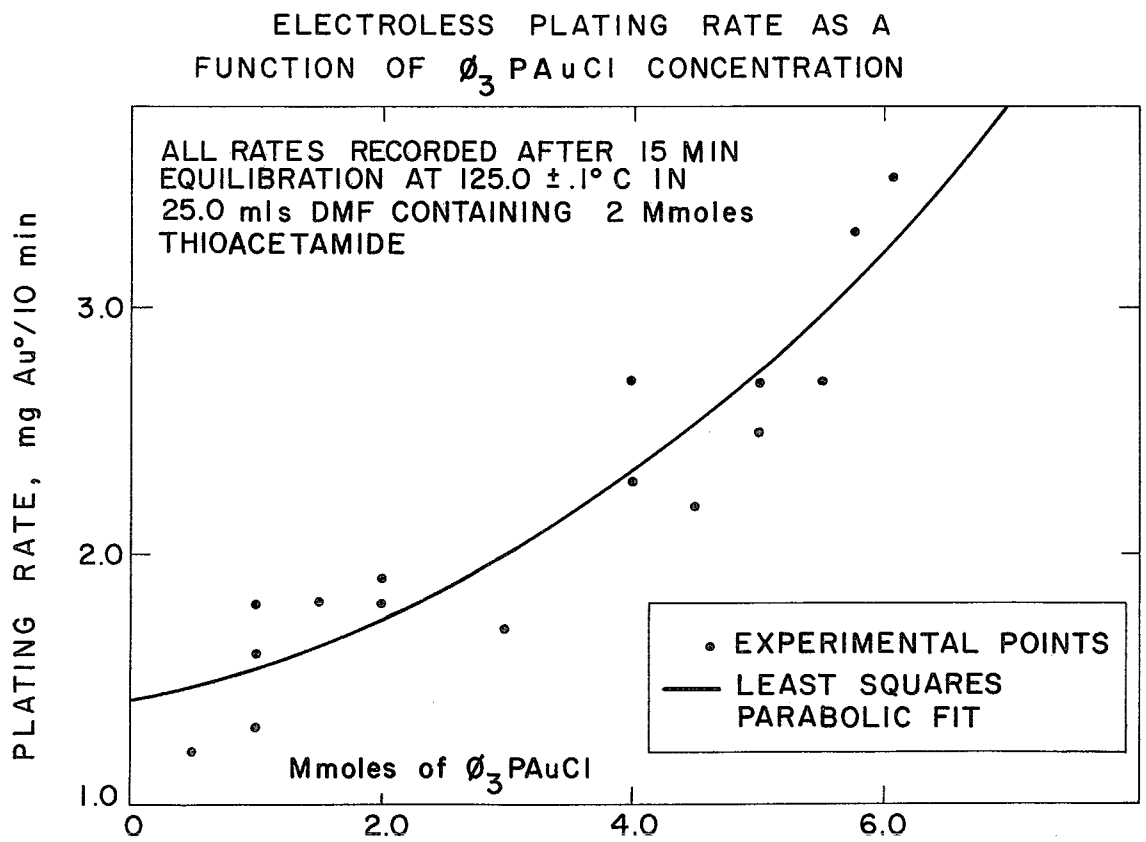
Figure 2:
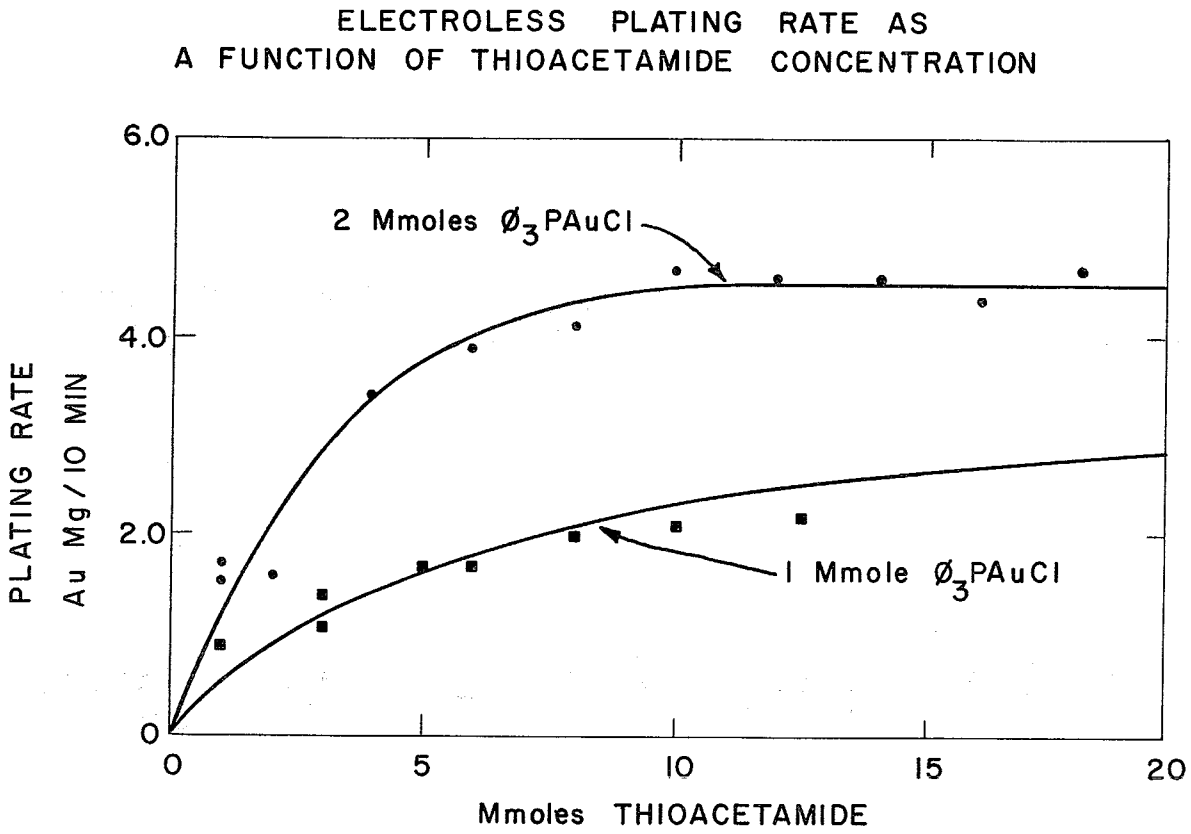

(each ∿ 2 sq. in. surface area)

PLATING RATE OF ELECTROLESS BATH MADE FROM ($Ø_3PAu$) AS A FUNCTION OF THIOACETAMIDE

GOLD DEPOSITION PROCEDURES AND SUBSTRATES UPON WHICH GOLD HAS BEEN DEPOSITED

This invention pertains to novel compounds, methods for making the compounds as well as methods for using these compounds and articles of manufacture obtained by practicing the methods for using the compounds. More particularly, this invention pertains to novel gold complexes, synthesis for obtaining the novel complexes, the use of the gold complex for deposition of gold on various substrates, either by an immersion, electroless, photolytic or chemical vapor deposition processes. Still further, the invention pertains to the method for using the novel gold complexes and methods for using complexes which have been known in the art and which have been used in a novel manner such as a photolytic compound selectively decomposed by masking a substrate. Additionally, complexes disclosed herein are used for depositing gold nuclei for catalyzing electroless plating baths particularly the gold electroless plating bath described herein.

As another aspect of the invention, various electroless bath compositions and immersion bath compositions useful for depositing gold on a number of substrates have been disclosed. Within the scope of the invention are, an immersion plating process, an electroless plating process, a photolytic deposition process, chemical vapor decomposition process, and a combination of photolytic and electroless process to additively plate on conductive and non-conductive substrates a layer of gold.

BACKGROUND OF THE INVENTION

The printed circuitry development has been one of the important elements in the tremendous growth of the electronic industry. As it is well known, printed circuitry may be obtained by a number of processes, the merits of which are disclosed in patents such as U.S. Pat. No. 3,562,005. In this patent the various prior art processes for the depositing of metal on a substrate have been evaluated with the shortcomings and advantages of each process being discussed. Moreover, in this patent the various means how electroless plating has been accomplished have been described. Still further, in U.S. Pat. No. 3,562,005, the "photo promoter" process has also been disclosed.

The further deposition of metal on the "photo promotor" deactivated surface is described as electroless plating in this patent as well as in a number of references. A further reference which is illustrative of the various processes is J. J. Webicki, *Practical Electroless and Immersion Plating*, Plating, volume 58 (8), pp 763–767 (1971).

Inasmuch as the electroless deposition takes place by the chemical reduction of a metal salt on the surface of a substrate, either on a metal or on a non-conductive substrate surface (which has been "catalyzed" to receive the metal sought to be deposited), various complexing agents have been proposed for forming a catalytic metal on the surface of a substrate. The search is still being continued for more easily controllable catalytic agents or catalytic agents which are capable of making an enhanced and stronger bond between the substrate, often an organic substrate, and the metal sought to be deposited.

Still further, a continuous search has been for complexes which would (a) lower the activation energy of the reactive methal or (b) increasee the solubility of the metal salt or the metal salts in the electroless bath. With respect to to the latter, the increased solubility provides an increase in concentration of the reactants and hence increases the reaction rate during the reduction reaction. With reference to approach (a) above, a lowering of the activation energy also implies an increase in reaction rate.

With respect to electroless plating, a number of drawbacks have become evident when using the prior art processes. For example, the pH and the temperature affect the reaction and must be carefully controlled because the electroless baths are usually operated at conditions at which the baths are likely to undergo homogeneous decomposition. Although buffering agents are used, sometimes to attempt the maintenance of the pH within as narrow range as possible, buffering agents introduce additional elements in the bath detrimental to the deposition process. Still further, wetting agents have been proposed as avoiding some of the problems and stabilizers have been employed which are alleged to improve the operation of the baths. Nevertheless, these agents and stabilizers again add further contaminant sources and thus potential contaminants are introduced in the bath. Hence, the baths become further hard to control because of the cumulative effect of the additives.

With respect to the prior art processes, many of the aqueous electroless and more particularly gold electroless plating solutions contain hypophosphites as the reducing agents. For example, U.S. Pat. Nos. 1,207,218 and 2,976,181 disclose bath containing hypophosphites as the reducing agent, but these baths are limited by reaction products generated in the bath. For example, phosphides and phosphates build up in the bath. Auto degeneration of reducing agents also sets in. These shortcomings of the prior art have been pointed out in other patents such as U.S. Pat. No. 3,032,436. In the last mentioned patent, it has been proposed to use hydrazine hydrate as the reducing agent to avoid the problems associated with prior art baths. However, hydrazine is a thermodynamically unstable material and is prone to spontaneous decomposition. In order to operate safely and obtain optimum limits when using bath with hydrazine as a reducing agent, the pH of the solution must be continually monitored and the reducing agent must be added in small quantities.

Although it is known that palladium salts may act as reducing agents, such as disclosed in U.S. Pat. No. 3,396,042, the pH of the solution must be carefully controlled between 8 to 11 and preferably on the high pH value side of this range. If the pH of the solution is not carefully controlled, codeposition of palladium is a continuous problem. Consequently, gold deposits are obtained with lower purity having undesirable characteristics making the gold deposits unacceptable for a number of different uses.

Additional patents have described the use of gold cyanide or potassium gold cyanide as the source of gold in an electroless bath. For example, U.S. Pat. No. 3,506,462 describes these cyanides but an extreme care must be exercised so that no acid is introduced in the bath which would cause the extreme toxicity associated with hydrogen cyanide. Still further, in many electronic applcations, especially for semi-conductor materials, the absence of sodium or potassium which is detrimental is very important. Hence, the plating of these materials with gold from potassium gold cyanide or utilizing an alkaline metal as the reducing agent or complexing agent is not acceptable. (Cf. U.S. Pat. No. 3,300,328).

For the reasons previously mentioned and for the further reasons that the electroless plating bath is operated under conditions such that spontaneous decomposition of the bath is likely to occur, the commercial usefulness of the baths have been limited or a need for considerable improvement manifested. Still further, the gold electroless baths have not been used because these baths have not been capable of regeneration once a small fraction of the gold has been removed, (i.e. 25%) and at these conditions the bath has stopped plating.

Although some phosphorous containing complexes and their use in immersion plating and thermal decomposition processes has been described in U.S. Pat. Nos. 3,438,805 and 3,492,151, the electroless process has not been described in these patents.

BRIEF DESCRIPTION OF THE INVENTION

It has now been found that an electroless gold plating system which is stable and in which the gold salts are relatively non-toxic and can be replenished has been provided by the formation of new gold complexes. Moreover, these new baths contain no alkaline metal, and are relatively insensitive to pH fluctuation. Gold plated from the newly discovered baths is of very high purity, ductility and conductivity. Still further, higher and controllable plating rates are achieved and lower porosity has been observed making the novel electroless plating process an economically attractive and desirable process. Moreover, an important feature of the present invention is that gold salts can be in the plus 1 valance state thus requiring less reducing agents. Still further, the novel plating bath contains a non-aqueous, highly polar solvent which solvent serves as a complexing and stabilizing agent, in addition, providing for a variety of gold salts a stabilizing medium.

Inasmuch as the non-aqueous, high boiling point polar solvents permit the utilization of a large variety of compounds which may serve as reducing agents, the advantages of the presently disclosed bath are enhanced. As a result, higher bath temperatures and faster plating rates are obtained; moreover, the use of polar organic solvents means higher purity gold deposits, no galvanic corrosion, and freedom from alkaline and other metal contaminants.

DESCRIPTION OF THE INVENTION

The metal salt complexes which are convertible to a novel thio compound, in situ, (but can be characterized for the thio compound by a picrate, or a tetraphenylborate also called tetraphenylboron) and are useful in accordance with the present invention are primarily a gold salt containing triorgano phosphine, arsine, or antimony ligands of the following formula:

$$(R_3L)_n[Au_y^v]X_m$$

where R can be hydrogen, halogen or a hydrocarbon group, e.g., alkyl, alkenyl, or alkinyl groups and substituted alkyl, alkenyl, or alkinyl groups, an aliphatic, i.e., hydrocarbon groups interspersed with oxygen, sulfur or phosphorus, cycloaliphatic, an aromatic, or a substituted aromatic radical; L is a ligand donor atom, and these comprise the following elements: phosphorous, arsenic, antimony, sulfur, and nitrogen, such as $R_3P$, $R_3As$, $R_3Sb$, and $R_3PS$; $n$ is generally 1 to 2 but can be up to 4, e.g., for a compound such as 1,1,4,7,10,10-hexaphenyl-1,4,7,10-tetra phosphadecane or tris (2-diphenyl phosphino ethyl) phosphine; $v$ is the valance of the Au, usually it is mono or tri; $y$ refers to the number of gold atoms per complex, usually one, two gold atoms per complex are within the contemplation of this invention, but three, four and more are possible by the polymerization of the complexes; X is an anion such as halogen, e.g., F, Cl, Br, and I, cyanide, thiocyanate, a nitrate, chlorate, borohydride and alkyl group such as mono, di or trialkyl groups of 1 to 4 carbon atoms, preferably trimethyl; m refers to the number of anions and is equivalent to the number of gold atoms times its valance v, and can be mixed anions.

In the formula above, examples of R as a hydrocarbon (saturated or unsaturated) include methyl, ethyl, propyl, isopropyl, n-butyl, iso-butyl, sec-butyl, tert.-butyl, amyl, heptyl, octyl, decyl, dodecyl; vinyl, propenyl, butenyl; acetylene; examples of R as cycloaliphatic include cyclopentyl, cyclohexyl and cyclooctyl; examples of R as an aromatic include phenyl, tolyl, xylyl, ethylphenyl, chlorophenyl, bromophenyl, and fluorophenyl; R may also be a simple halogen such as chlorine or bromine or it may be hydrogen, generally less than (once or twice) per ligand for each, or bromine or cyanoethyl or methoxy, ethoxy, propoxy, or butoxy; phenoxy; tolyoxy; etc.

R can be a mixture of the above, e.g., phosphine, diphenylphosphine and allyl, phenyl phosphine.

The ligand ($R_3L$) may contain in place of R more than one phosphorous atom such as bis(1,2 diphenylphospheno) ethane commonly called DIPHOS.

In general, the complexes described above are believed to be converted, in situ, to sulfide of the formula as further explained herein:

$$(R_3LAu)_{\frac{2n}{2n}}S_n$$

wherein R is at least one of the above mentioned alkyl groups of 1 to 12 carbon atoms; or an alkenyl group of 1 to 7 carbon atoms; or an alicyclic group of 5 to 8 carbon atoms; or an aromatic group; or an alkoxy group of 1 to 7 carbon atoms; or a phenoxy or substituted phenoxy.

Further, R may be an alkyl amino group, substituted alkyl with (a) an alkyl amino group wherein the alkyl group is of 1 to 8 carbon atoms and is mono or di substituted on said amino group with an alkyl group of 1 to 2 carbon atoms, (b) a cyano, (c) phenyl, (d) diphenylphosphino, (e) diphenylarsino; or a phenyl substituted with (a) halo from 1 to 5 times, (b) mono aminoalkyl of 1 to 2 carbon atoms in the amino group, (c) mono or di alkoxy group of 1 to 4 carbon atoms, (d) mono or di alkyl group of 1 to 4 carbon atoms, (e) diphenylphosphino, (f) ferrocenyl, (g) diphenylarsino; or alkenyl of 2 to 4 carbon atoms substituted with diphenylphosphino; or alkinyl of 2 carbon atoms substituted with diphenylphosphino; alkyl amino of 1 to 2 carbon atoms in said dialkyl group; a polyalkylene chain interspersed with one or two O or S atoms and having from 2 to 4 carbon atoms in each alkylene unit; or hydrogen, provided at least one group is other than hydrogen; halogen such as fluoro, chloro, bromo, iodo, provides at least one group is other than halogen; or R can be the ligand $R_2L$ wherein R is as defined above and L is P or As; or mixtures of the above moieties (found in the above complexes) are within the scope of the invention. In the formula above L may be phosphino, arsino, stibino, or phosphorous sulfono, i.e., $R_3PS$. The precursors for the above complexes or their equivalents are disclosed in catalog No. 6 by Strem Chemicals, Inc., 150 Andover Street, Danvers, Mass. 01923.

More specifically, the active complex formed, in situ, in that plating bath, is sulfide of the formula $$(R_3\,P\,Au)_2\,S$$

wherein R is at least one of an alkyl group of 1 to 12 carbon atoms; or an alkenyl group of 2 to 3 carbon atoms; an alicyclic group of 6 to 8 carbon atoms; a phenyl group; an alkoxy group of 1 to 8 carbon atoms; or a phenoxy or tolyloxy; an alkyl group of 1 to 6 carbon atoms substituted with a dialkylamino group of 1 to 2 carbon atoms in the alkylamino alkyl group, a cyano group, a phenyl group, diphenyl phosphino; or phenyl substituted with chloro, bromo or fluoro from 1 to 5 times, dimethylamino, monoalkoxy group of 1 to 2 carbon atoms, diphosphino or phosphinodiphenyl; dimethylamino; tetraphenyl triphosphadecane; or hydrogen, provided at least one R group is other than hydrogen, or halogen; and if P occurs more than once in the molecule, then Au may be equivalent in number to P or less than P.

In the formula above $R_2P$ may also be substituted in place of one R. Moreover, the recited R moieties may be mixed.

Specific examples of the complexes that are illustrative of the present invention or for the deposition of a metal residue are as follows:

| | | |
|---|---|---|
| $(C_2H_5)_3\,P\,Au\,Cl_3$ | $(C_2H_5)_3\,P\,Au\,Cl$ | |
| $(C_4H_9)_3\,P\,Au\,Cl_3$ | $(n\,C_4H_9)_3\,P\,Au\,SCN$ | |
| $(C_6H_5)_3\,P\,Au\,Cl$ | $(C_6H_5)_2{-}\underset{\underset{Au\,Cl}{\vert}}{P}{-}CH_2{-}CH_2{-}\underset{\underset{Au\,Cl}{\vert}}{P}{-}(C_6H_5)_2$ | |
| $(C_6H_5)_3\,P\,S\,Au\,Cl$ | $(C_6H_5)_3\,PS\,Au\,Cl_3$ | |
| $(C_6H_5)_3\,P\,Au\,S\,CN$ | $(C_6H_5)_3\,P\,S\,Au\,Cl$ | |
| $(C_6H_5)_3\,P\,Au\,Cl_3$ | $[(C_6H_5)_3\,P\,Au]_2C_2O_4$ | |
| $(C_6H_5)_3\,P\,Au\,Br_2\,Cl$ | $(C_6H_5\text{-}O)_3\,P\,Au\,Cl$ | $(CH_3\text{-}O)_3\,P\,Au\,Cl$ |
| $(C_6H_5)_3\,As\,Au\,Cl$ | $(C_6H_5)_3\,P\,Au\,I$ | $(C_6H_5)_3\,P\,Au\,I_3$ |
| $(CH_3)_3\,P\,Au\,Cl$ | $(C_6H_5)_3\,P\,Au\,Br$ | $(C_6H_5)_3\,P\,Au\,Br_3$ |

In accordance with the electroless plating process and according to the present invention, the following reaction mechanism has been established along with identification of the intermediate compounds according to the reaction scheme. The steps in plating reaction are as follows:

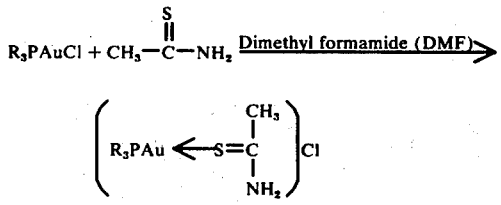

where R is a radical such as defined above. Solubility of I in DMF is limited. The addition of II brings I into solution. FIG. I reveals the relationship between the rate of Au deposition and concentration of I while FIG. II shows the influence of II on the plating rate.

B.

$$III + I + \text{nucleonphile} \quad R_3\,P\,Au - S - Au\,P\,R_3 \qquad IV$$

Bis triphenylphosphine gold sulfide (IV) prepared, in situ, has been isolated from solution and identified by elemental analysis; the plating compound (IV) generated in-situs, has not been reported in the literature. A nucleophile such as $(CH_3)_2NH$ is present in solvent DMF. Other useful nucleophiles are water, hydrogen sulfide, thioacetamide, acetamidine, ammonia, carbon monoxide, chloride, bromide, iodide or fluoride ions, bisulfide ion, hydroxyl ion, carbonate $CO_3$—; or acetate $CH_3CO$—.

C.

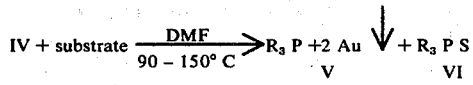

Complex VI is identified as a reaction product; the addition of V to plating bath inhibits the plating rate until II reacts with it and forms VI and when nucleophiles such as dimethyl amidine is present.

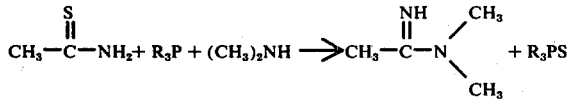

Figure 3:
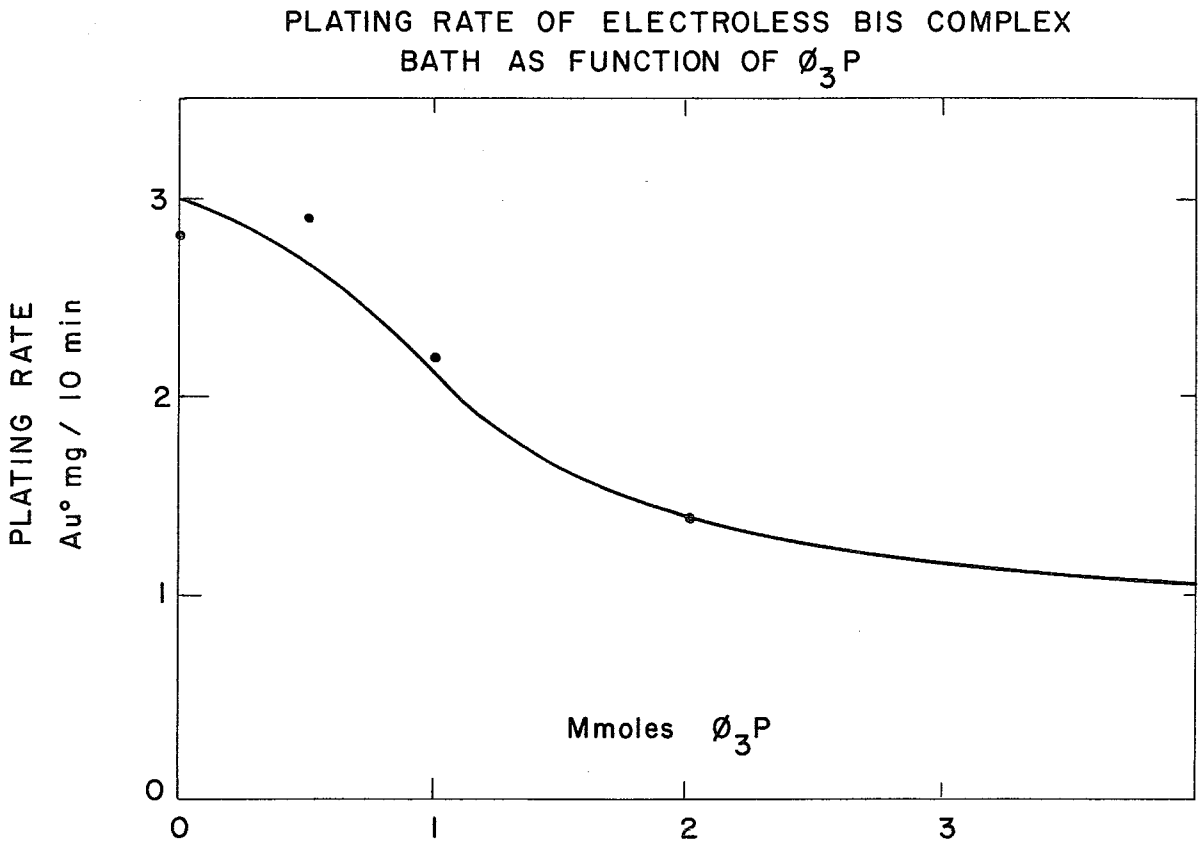

FIG. 3 indicates a decrease of plating rate and leveling off with the addition of V to a solution of IV.

The kinetics of Au deposition from the active species IV have been determined to be zero order indicating that a slow step in the heterogeneous decomposition is the absorption of IV onto gold substrate as shown in equation (C).

Figure 4:
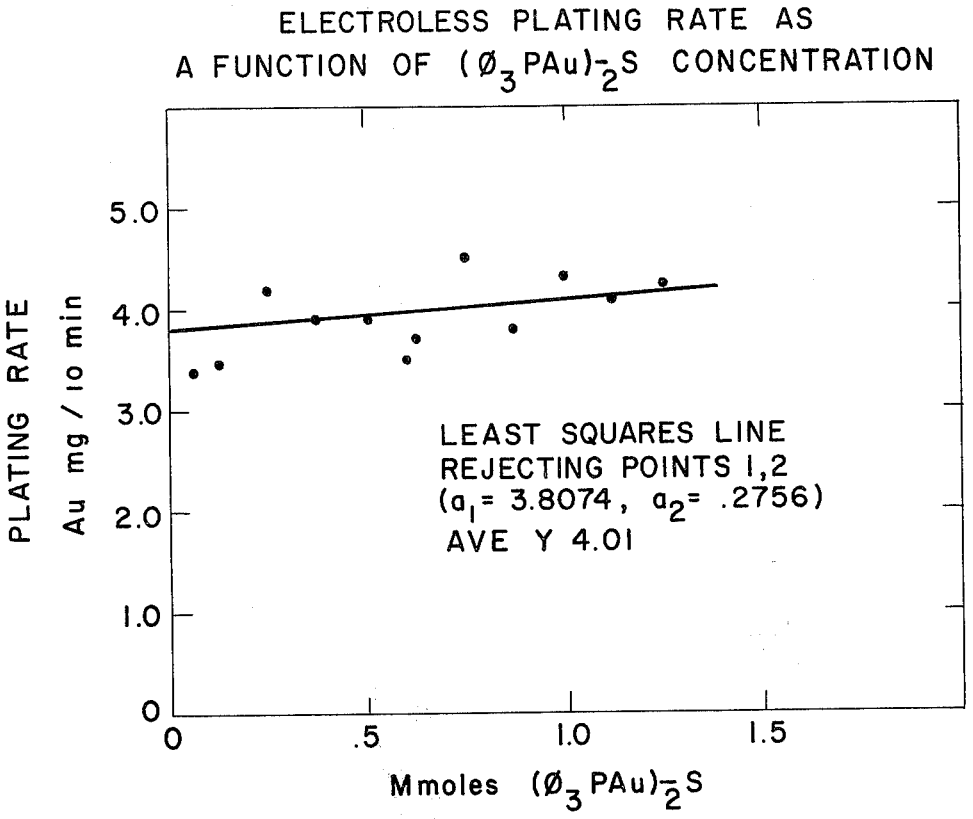

FIG. 4 shows that the plating rate is essentially independent of concentration of IV.

Figure 5:
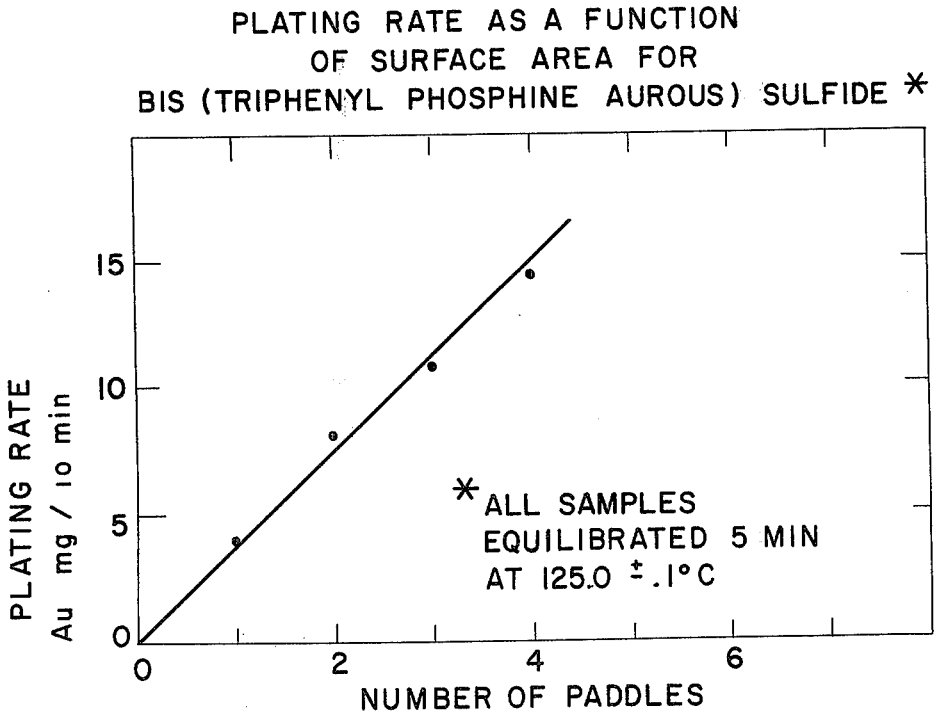

FIG. 5 demonstrates that plating rate is directly proportional to plating areas of substrate.

Figure 6:
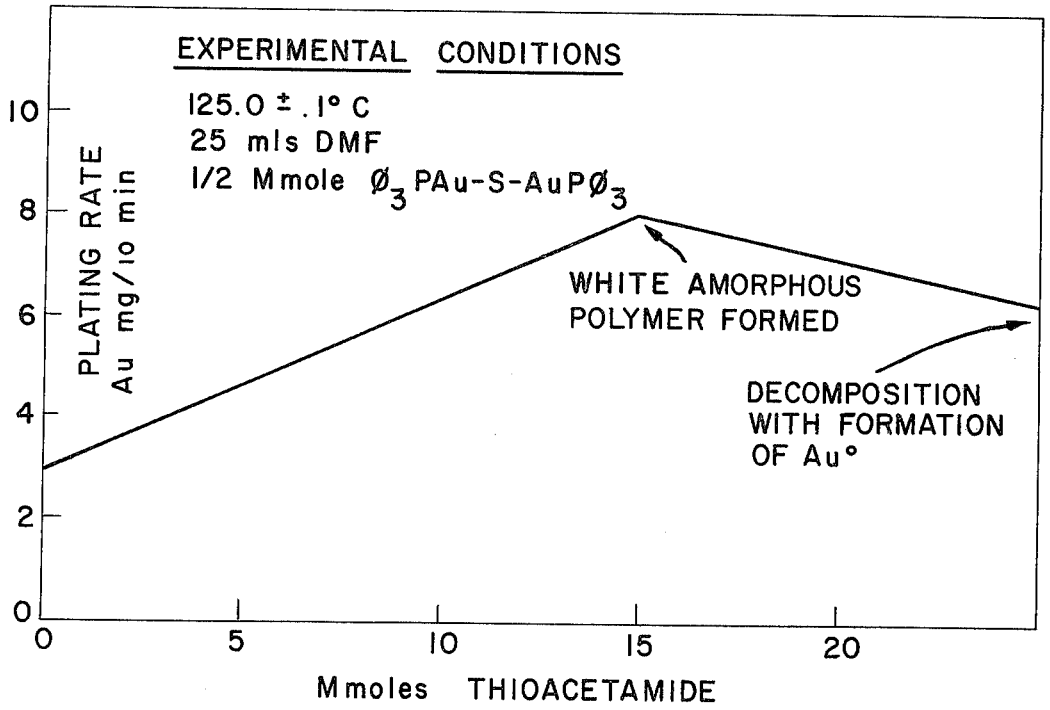

If $R_3\,P\,Au - S - Au\,PR_3$ exceeds concentration limit, polymerization of the complex occurs; this is shown in FIG. 6. The addition of $(C_6H_5)_3\,P$ will redissolve the polymerized complex and stabilizes the bath.

If large excess of II is not present in plating solution, the following reaction may occur:

$$I + IV \rightarrow (R_3\,P\,Au)_3\,S\,Cl \qquad (VII)$$

Complex VII is identified by following reagents: Na +(picrate)— and Na +(B $R_4$)— and precipitates identified as:

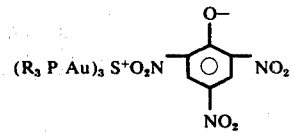

-continued and $(R_3 P Au)_3 S^+(B R_4)^-$ , where R is phenyl group.

Thus, in accordance with the present invention the preferred novel species for electroless plating is the following compound.

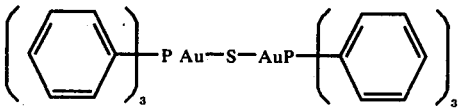

which is formed in situ by the reaction of triphenylphosphine complexes with thioacetamide in polar solvents.

In reference to the non-aqueous, polar solvents which have been found to be satisfactory, these are dimethylforamide, hexamethylphosphoramide, dimethylacetamide, N-methylpyrrolidone or dimethyl sulfoxide; other highly polar non-aqueous solvents which are suitable for some of the systems are, as further amplified below e.g. acetonitrile, and methyl formamide.

As reducing agents and activators useful in this electroless plating process, the following have been found outstanding: thioacetamide, thiodiacetamide and thioacetic acid. Other compounds which act as accelerators or stabilizers found to be useful, are grouped for their general function.

A. Reducing agents
1. thioacetamide
2. thiodiacetamide
3. thioacetic acid
4. thiourea acid
5. hydrogen sulfide
6. thiocarbanyl sulfide
7. thiobenzamide
8. sulfur
9. selenium dimethyldithiocarbamate
10. tellurium diethyldithiocarbamate B. Accelerator and stabilizers with thioacetamide
1. acetic acid
2. chloroauric acid
3. hydrogen chloride The above compounds used in combination with the electroless bath promote the plating or increase the stability of the plating bath without detrimentally affecting the end result.

Illustrative Embodiments of the Invention

A. Electroless plating bath

In reference to the electroless plating the constituents and their concentration in a typical electroless bath are given below and the operating parameters of the electroless plating are illustratively taught such as in Table I below.

TABLE I

| FUNCTION | COMPOUND | RANGE | OPTIMUM |
|---|---|---|---|
| Gold Reactant | $\phi_3$P AuCl | 1 - 200 gm/li | 40 gm/l |
| Reducing Agent | $C_2H_3S$ $NH_2$ | 1 - 400 gm/li | 20 gm/l |
| Solvent | $HCON(CH_3)_2$ | | |
| Bath Temperature | ° C | 40 - 150° C | 130° |
| Plating Rate for gold on gold | mg/cm²/hr. | 1 - 40 | 14 |
| Work Load* | cm²/cm³ | .1 - .5 | .2 |

*-Ratio of surface area of part to volume of bath.
$\phi$ is —($C_6H_5$)

In respect to other bath compositions these have been illustrated in Tables II, III and IV below. In reference to Table II, it demonstrates a large variety of phosphine gold salts which are suitable as plating agents, and the deposition rate of these are dependent on the structure of the complex. In general, the lower the decomposition temperature of the complex, the lower is the temperature of the plating bath at which equivalent deposition rates can be obtained. Although there is a definite advantage in using lower plating temperatures other economic factors are necessarily determinative such as synthesis cost, bath stability, the rate of plating, bath life, etc.

TABLE II

PLATING RATES FOR BATHS CONTAINING VARIOUS GOLD, COMPLEXES, EMPLOYING THIOACETAMIDE AS THE REDUCING AGENT AND DMF AS THE SOLVENT.

| Gold Complex | [Complex] gm/l | [Thioacetamide] gm/l | (Accelerators) gm/l | PLATING TEMPERATURES ° C — RATES IN $10^{-3}$ gms/cm² 1 hr. 40 | 50 | 60 | 70 | 80 | 90 | 100 | 110 | 120 | 130 | 140 |
|---|---|---|---|---|---|---|---|---|---|---|---|---|---|---|
| $Et_3P$ Au $Cl_3$ | 40 | 40 | — | 2.7 | 3.9 | 4.2 | 6.9 | | 10.2 | — | — | — | — | — |
| $Bu_3P$ Au $Cl_3$ | 40 | 20 | Ethyl Tellurac* 4 gm/l | — | — | 1.0 | 7.1 | | 5.7 | 6.2 | 6.9 | 4.7 | 2.1 | — |
| $\phi_3$P S Au Cl | 40 | 20 | | — | — | — | — | | 5.7 | 9.0 | 5.6 | 6.0 | 7.2 | — |
| $\phi_3$P Au SCN | 40 | 20 | Na.methylate 20 gm/l | — | — | 0.2 | 0.2 | | 0.2 | 0.2 | — | — | — | 1.5 |
| $\phi_3$P Au $Br_2$ Cl | 40 | 20 | | — | 0.8 | 1.5 | 2.0 | | 2.3 | 1.2 | 1.7 | 1.7 | 5.0 | 8.2 |
| $\phi_3$P Au $Br_2$ Cl | 40 | 40 | — | 1.2 | 0.9 | 1.0 | 1.3 | | 1.5 | 2.2 | 6.6 | 9.7 | — | — |

*Tellurium Diethyldithio-carbamate
$\phi$= $C_6H_5$

In reference to Table III, it depicts electroless gold plating baths with various reducing agents and the deposition rates achieved as a function of temperature of these agents. As it is evident from Table III, it is fairly important to observe that thioacetic acid is a more effective agent than thioacetamide but because of the other factors such as ease of handling, lack of odor, etc., thioacetamide is preferred.

TABLE III

PLATING RATES FOR BATHS WITH VARIOUS REDUCING AGENTS, EMPLOYING 40 gm/liter $\phi_3$ P Au Cl AS THE GOLD COMPLEX AND 200 mls OF DMF AS THE SOLVENT

| Reducing Agent | gm/li | Plating Temperature - ° C (Rates in $10^{-3}$ gm/cm²/hr.) 70 | 80 | 90 | 100 | 110 | 120 | 130 | 140 |
|---|---|---|---|---|---|---|---|---|---|
| Thiodiacetamide | 20 | — | — | 2.5 | 3.6 | 5.4 | 8.2 | 13.2 | — |

TABLE III-continued

PLATING RATES FOR BATHS WITH VARIOUS REDUCING AGENTS, EMPLOYING 40 gm/liter $\phi_3$ P Au Cl AS THE GOLD COMPLEX AND 200 mls OF DMF AS THE SOLVENT

| | | Plating Temperature - ° C | | | | | | | |
|---|---|---|---|---|---|---|---|---|---|
| | | 70 | 80 | 90 | 100 | 110 | 120 | 130 | 140 |
| Reducing Agent | gm/li | (Rates in $10^{-3}$ gm/cm²/hr.) | | | | | | | |
| Thiodiacetamide | 20 | — | — | 0.3 | 0.2 | 0.2 | 0.5 | 0.5 | — |
| Thiodiacetamide Acid | 20 mls | — | — | 1.0 | 3.4 | 5.7 | 10.6 | 12.3 | — |
| Thiourea | 40 | — | — | — | — | 6.3 | 0.3 | — | — |
| $H_2S$ | Satu. Soln. | — | — | — | 1.6 | 7.2 | 15. | — | — |
| Thiocarbonyl Sulfide | 20 | — | — | — | 1.8 | 0.8 | 1.2 | 0.6 | 0.5 |
| Thiobenzamide | 60 mls | — | — | — | — | — | 2.6 | — | — |
| Sulfur | 10 | — | — | — | 0.2 | 1.3 | 1.6 | 2.2 | 1.5 |
| Selenium | 10 | — | — | — | — | — | 1.0 | 1.3 | 2.7 |
| Methyl Selanac* | 10 | — | — | 0.7 | 0.9 | 1.2 | 1.5 | 4.0 | — |
| Ethyl Telluroc** | 20 | 4.5 | — | — | 5.0 | — | — | — | — |

*-Selenium Dimethyldithiocarbamate $\phi$ is $C_6H_5$—
**-Teleurium Diethyldithiocarbamate In reference to Table IV, it depicts the effect of the deposition rate as influenced by various accelerators. Triphenylphosphine gold chloride-thioacetamied bath containing various accelerators show the various deposition rates obtainable by the novel bath. It is noted that acetic acid markedly accelerates the deposition rate; it also tends to reduce sulfite formation when plating electrolessly on metals such as copper.

TABLE IV

DEPOSITION RATES FOR VARIOUS ADDITIVES IN THE DMF PLATING BATH CONTAINING $\phi_3$ P Au Cl and $C_2H_5SNH_2$

| | | | | Temperature - ° C | | | | | | | | | | |
|---|---|---|---|---|---|---|---|---|---|---|---|---|---|---|
| $\phi_3$ P Au Cl | Thiodiacetamide | Accelerator | gm/li | 40 | 50 | 60 | 70 | 80 | 90 | 100 | 110 | 120 | 130 | 140 |
| | | | | (Plating Rate - $10^{-3}$ gm/cm²/hr | | | | | | | | | | |
| 100 | 70 | Acetic Acid | 60 mls | — | — | — | — | 2.6 | 4.5 | 11.2 | 16.0 | 11.8 | 17.8 | 36.0 |
| 70 | 90 | Chloroauria Acid | 30 | — | — | — | — | — | — | 7.3 | 6.4 | 5.9 | 0.3 | — |
| 40 | 80 | Hydrachloric Acid | 60 mls | — | — | — | — | — | — | — | — | 6.0 | — | — |
| 40 | 50 | Sodium di-hydrogen phosphite* | 60 mls | 2.4 | 3.3 | 2.7 | — | — | — | — | — | — | — | — |
| 40 | 20 | Accelerator No. 552** | 20 | — | — | — | — | 0.6 | 1.0 | 1.8 | 3.0 | 9.7 | 28.0 | — |
| 40 | 20 | Argalt** | 10 | — | — | — | — | — | — | 1.0 | 3.7 | 7.4 | — | — |
| ***40 | 20 | None | — | — | — | — | — | — | 0.3 | 0.2 | 0.2 | 0.5 | 0.5 | — |

*-Saturated Solution
**-Rubber Accelerators
***-Control
$\phi$ is $C_6H_5$-

In reference to the use of the solvents, these are also of importance in the deposition rate; and when using dimethylformamide as a solvent, the rates were found to be higher than when using merely formamide such as in a triphenylphosphine gold chloride-thioacetamide bath. The boiling point of the solvent affects the deposition rate. The higher the boiling point, the higher the temperature at which the bath can be operated and the higher the plating rate. A solvent such as N-methyl-2-pyrrolidone which boils at 202° C makes an excellent plating bath. Highly polar compounds are good solvents since these increase the solubility of the reactants. A list of solvents are provided above.

In reference to the substrates which have been employed in the electroless deposition, as metals the following are useful: aluminum, copper, nickel, steel, Kovar (an iron-nickel alloy), and alloys of each thereof; as acceptable thermoplastic or thermoset polymers: epoxies, Teflon, e.g., diallylphthalates, fluorinated ethylene propylene, polyimides, polyesters, phenolics; as ceramic such as alumina and mullite; and as glasses such as quartz, pyrex, and soda glass.

In general, a coating rate of 100 micro inches/in² of surface area/hr. is achieved, the electroless bath will plate on gold (gold on gold) which is a sign of true electroless process and thickness up to 600 micro inches have been observed (about 4 to 6 hour plating period).

A metal catalyst is needed to initiate the reaction on non-conductive substrates. Besides gold, a number of other metals have been found to be effective, these are: Pd, Pt, Ir, Rh, Ag, Ni, Cu, Fe, Co, etc. These metals are usually applied as metal salts (halides, nitrates, etc.). Usually the substrate is immersed into a solution in which the salt is soluble as ions or colloids. After a time period in which the salt is absorbed, the substrate is withdrawn, rinsed, and placed in a solution containing a reducing agent or directly into the electroless plating bath which contains a reducing agent. These listed metals may not work as true catalysts since the bath may first immersion plate the listed catalytic metal with gold. Gold is the most easily displaced metal from solution of all the metals in the electromotive series and, therefore, would tend to immersion plate the metal on the plastic surface but whether the kinetics for the immersion process is faster than the catalytic properties of the metal is not known.

As one of the outstanding characteristics of the above electroless process, the bath does not display contamination, the plating bath can be used for over a prolonged period of time such as 2 months without encountering adverse effects, the bath can be regenerated repeatedly by the addition of gold complex and reducing agent and the coatings are still adherent and relatively pore free. Inasmuch as the coatings are low in porosity and are evenly distributed over complicated parts, the usefulness of the electroless gold bath manifests itself. Since the electroless process does not require anodes as in electroplating bath there is not the problem of variation in coating thickness due to the distance between the part and the electrode.

B. The Photolytic Process

It has also been discovered that some of gold complexes, e.g., $(R_3 P)$ Au $X_3$, X is halogen, can be photolytically decomposed at room temperature to deposit gold nuclei. These nuclei will initiate electroless plating by the gold bath described in this application as well as commercial gold, nickel, or copper electroless plating baths. By exposing the complexes to ultraviolet light (UV) through a mask, selective metallization of a substrate is possible. An example of the process is described below. It has been discovered that $R_3$ P AuX can be photolytically sensitized to thermal decomposition but these +1 complexes cannot be decomposed by UV light at room temperature.

The substrate is dipped into a chloroform solution of triphenyl phosphine gold trichloride (100 gm/l) and slowly withdrawn at a rate equivalent to evaporation rate of solvent to obtain a uniform coating of light sensitive complex on the substrate.

A mask is placed on the substrate and exposed at room temperature to ultraviolet irradiation from two 750 watt high intensity Hg vapor lamps for less than 3 seconds. A longer time is required to decompose the complex with lamps of lower intensity, i.e., 250 watt Hg vapor lamp requires 1½ minutes. After exposure the mask is removed and the substrate is rinsed with a solvent (acetone, etc.) to wash or dissolve away the complex not exposed to UV. The complex exposed to UV decomposes to deposit gold which remains on the substrate. The deposited gold appears purple in color due to the small particle size (~1000A). These gold nuclei will catalyze the deposition of gold in commercial electroless gold bath, e.g., the bath further described herein and designated as B or in other electroless gold bath described herein. The selective decomposition of light sensitive gold complexes and the ability of gold nuclei to catalyze electroless gold plating results in an additive process for plating gold in selected area on the substrate. Using the additive process, printed circuitry has been deposited on substrates such as alumina wafers, and polyimide film (Kapton), quartz blanks, microscope slides, silicon wafers, epoxy glass fiber reinforced boards (g-10) and passivated aluminum metal.

In addition to the above additive method, the photolytically deposited gold nuclei will reduce noble metal ions to zero valence state which in turn are useful as active catalyst for electroless plating. The process is carried out as follows, the plastic film is immersed in a solution of a trivalent gold complex and irradiated with a light through a mask, the decomposition of the gold complex in the irradiated areas cause the gold nuclei to form. After the substrate is exposed and the unexposed gold complex rinsed away, the film may be dipped in a solution of a palladium salt and a reducing agent, such as ferrous ion, vanadium ion, hydroquinone, etc. The gold particles catalyze the reduction of the palladium ion to palladium metal in the exposed areas. The film can then be rinsed and the obtained pattern can be built up in a conventional electroless bath, such as an electroless copper or nickel bath further illustrated below.

As it is obvious from the above, the gold nuclei formed by the decomposition of the gold complex serve as sites (in the exposed areas only) for the reduction of palladium metal. Hence, the selective patterning is obtained as a combination of two steps, i.e., using the photolytically active gold in combination with a palladium metal salt. Thereafter, the obtained pattern is exposed in a commercial electroless bath for depositing a selected metal such as copper, nickel, cobalt, etc. which can be suitably employed to obtain the desired metal deposits.

Although gold nuclei will catalyze the deposition of nickel or copper from commercial electroless plating solutions as well, the initial plating rate is slower, consequently, the palladium is used in combination with the gold.

TABLE V

| Electroless Plating Processes | |
|---|---|
| Electroless Plating Bath | Catalytic Reagent |
| A. Electroless gold[1] | Photolytic Au Complex (UV-Au)* |
| B. Electroless gold-B[2] | (UV-Au) |
| C. Electroless gold bath-C[3] | (UV-Au) |
| D. Electroless Ni Plating Baths as disclosed in U.S. Patent 2,532,283 | UV-Au** or UV-Au followed by reduction of Pd salt. (UV-Au-Pd) |
| E. Electroless Ni Bath or Cahill's[4] | |
| F. Electroless Cu Bath[5] | (UV-Au-Pd) |
| G. Room Temperature Electroless Cu Bath[6] | UV-Au or UV-Au-Pd |
| H. High Temperature Electroless Cu[7] | UV-Au or UV-Au-Pd |
| I. MacDermide's Metex Electroless Cu 9038 | UV-Au or UV-Au-Pd |

[1]U.S. Patent No. 3,396,042.
[2]U.S. Patent No. 3,589,916.
[3]Okinaha, Plating, pp. 914–18, Sept., 1970.
[4]A. E. Cahill, Proc. Am. Electroplaters Soc., 44, pp. 130–1, June, 1957.
[5]U.S. Patent No. 2,874,072.
[6]U.S. Patent No. 2,874,072.
[7]U.S. Patent No. 3,310,430.
*-Complexes decomposed at room temperature by light from two 750 watt Hg vapor lamps - 2567 A°.
**-While photodecomposed gold will catalyze bath, the reduction of Pd salt shortens the time for plating iniation.

A generalized formula for photolytic complexes is $R_3P$ Au $X_3$ where R can be H, aliphatics, aromatics, amine containing hydrocarbon or a heterocyclic radical; when R is H, at least one other R must be the remaining substituent (the moiety R is that previously listed); where P is a phosphorous ligand atom and in addition may be As; X is a halogen, Cl, Br or I but mixed halogens as well as thiocyanate and cyanide halogen combination will also decompose. A partial list of photodecomposable complexes is illustrated below:

$CH_3$ P Au $Cl_3$
$C_2H_5$ P Au $Cl_3$
$C_3H_7$ P Au $Cl_3$
$C_4H_9$ P Au $Cl_3$
$R_3$ P Au $Cl_3$
$R_3$ P Au $Br_3$
$C_4H_9$ Au $Br_3$
$C_2H_5$ Au $Br_2$ Cl
$R_3$ P Au Br $Cl_2$
$R_3$ P Au $Cl_2$ CN

R is a radical such as ($C_6H_5$—).

The above list of compounds have been found to be decomposed by two 750 watt high intensity Hg vapor lamps. The time exposure is 10 minutes or less.

The synthesis of $R_3$ P Au $Cl_3$ is by an oxidation addition reaction which is accomplished by bubbling chlorine gas into a solution of $R_3$ P Au Cl in carbon tetrachloride. The other compound in the above list may be prepared in a similar manner or by exchanging with appropriate salts according to the following reaction:

a. The general preparation route is $$R_3PAuCl + Cl_2 \xrightarrow{CCl_4} R_3PAuCl_3$$

b. In order to obtain radicals other than halogens, the reaction is as follows:

$R_3PAuCl_3$ + 3NaBr (or 2 or 1 NaBr or NaCN or NaSCN) (one sodium atom displaces one chlorine)

C. The Immersion Plating Process

Although it has been suggested in the prior art that gold deposits can be made by an immersion technique, as mentioned previously, these prior art baths are quickly exhausted and plating does not continue after a small portion of the complex has been removed from the bath. According to the present process, more than 50% of gold can be depleted from the bath and plating can still continue if the triphenylgold thiocyanate is used as the complex in a bath for depositing a gold coating. An outstanding characteristic of the immersion coating process is the substantially porosity free deposits which have been obtained. Consequently, the discovered process is outstandingly useful for plugging pores on gold coating obtained by electrolytic or electroless processes. Thus, the immersion coating techniques provide a means for upgrading rejected parts due to porosity and to meet product performance standards of parts which previously were scrapped. Other characteristics which make the present processes especially desirable is that the immersion coating process is not susceptible to contamination of the substrate when used according to the presently disclosed conditions. Still further, deposits which have been obtained according to the present process have displayed outstanding coverage.

Immersion Technique

Gold plated parts which were scrapped for failure to pass porosity tests A and B further defined below are salvaged by the following procedure.

Parts are degreased and dipped into dimethylformamide solution containing 40 gm of $R_3$P Au SCN per liter. The immersion time is from 1 to 10 minutes with 5 minutes as the usual time. The bath is maintained at a temperature of 125° C. Lower temperatures may be used but this only increases the plating time. Bath temperatures above 150° C lead to decomposition of the complex and a high solvent evaporation rate. R in the formula above are aliphatic or aromatic radicals such as ethyl or phenyl, i.e., alkyl of 1 to 7 carbon atoms and phenyl and substituted phenyl as illustrated above. Solvents mentioned before are also suitable herein.

Test A procedure is described in: F. V. Bedetti and R. V. Chiarenzelli, "Porosity Testing of Electroplated Gold in Gelled Media", *Plating*, 53, pp. 305–8, March, 1966.

Test B procedure is described in: R. M. Burns and W. W. Bradley, "Protective Coating for Metals", Reinhold Publishing Corporation, New York, p. 350 (1967).

D. The Chemical Vapor Decomposition Process

In accordance with the present invention and as a further embodiment for utilizing the novel gold complexes as well as complexes which have been previously disclosed, it is found that if a gold complex possesses a sufficiently high vapor pressure, then upon vaporization of the complex, suitably in a reduced pressure atmosphere, the vapors formed thereby, when contacting a heated substrate, will deposit gold on the heated substrate. For example, it has been found that tri-n-butyl phosphine gold chloride which boils at 210° C at 0.03 mm/Hg will decompose on hot copper substrate above 350° C.

The following gold complexes which are suitably employed in the chemical vapor decomposition process have advantageous vapor pressure characteristics; these and the useful temperature at which decomposition on the hot substrate takes place are set forth below.

According to the process an outstanding characteristic of the chemical vapor decomposition is that the process is not limited to specific reducing agents, a fast coating rate is achieved such as in excess of 1 mil per hour, and highly complex parts may be uniformly plated with adherent gold coating. Typical vapor plating conditions are listed below.

| Complex Formula | Vaporization T ° C | Substrate T ° C | System Press mm of Hg | Dep. Rate Mils/hr. |
|---|---|---|---|---|
| $(n—C_4H_9)_3$ P Au Cl | 210–240 | 300–340 | 2–3 | 0.64 |
| Other complexes which are adoptable for the above procedure are: | | | | |
| $(C_2H_5)_3$ P Au Cl | | $(C_6H_5)_3$ P Au Cl | | |
| (iso $C_3H_7)_3$ P Au Cl | | $(C_6H_5)(Cl)_2$ P Au Cl | | |
| $(C_3H_5)_3$ P Au Cl —$C_3H_5$ is an allyl moiety. | | | | |

What is claimed is:

1. A process for depositing on a substrate gold from a solution, the process comprising:

a. introducing into a polar, non-aqueous solvent a ligand of the formula $$(R_3L)_n\,[Au_y^r]X_m$$

wherein R is at least one of hydrogen, hydrocarbon group, an aliphatic group; cycloaliphatic; an aromatic group; substituted aromatic group, halogeno, or a heterocyclic group; L is phosphorous, arsenic, antimony, sulfur, or nitrogen, Au is replaceable with As or Sb, v is the valance of the Au group, X is an anion of F, Cl, Br, I, Cn, thiocyanate, a nitrate, chlorate, borohydride, or alkyl of 1 to 4 carbons; *m* is the number of anions and is from 1 to 3, *y* is equivalent to *n* or 1 or 2 and *n* is from 1 to 4;

b. adding to the solvent a reducing agent, and c. introducing into said solvent in the presence of a nucleophile the substrate for depositing gold thereon.

2. The process as defined in claim 1 and wherein the substrate is: aluminum, copper, nickel, steel, or alloys thereof, thermoplastic or thermoset polymers, ceramics or a glass.

3. The process as defined in claim 1 and wherein the substrate is non-conductive and has thereon a catalyst for initiating the electrodeposition of gold.

4. The process as defined in claim 1 and wherein the polar solvent is dimethylformamide, hexamethylphosphoramide, dimethylacetamide, N-methylpyrrolidone, acetonitrile, methyl formamide, dimethyl sulfoxide, or mixtures thereof.

5. The process as defined in claim 1 and wherein the reducing agent is selenium, thioacetamide, thiodiacetamide, thioacetic acid, thiourea acid, hydrogen sulfide, thiocarbanyl sulfide, thiobenzamide, sulfur, selenium dimethyldithiocarbamate, or tellurium diethyldithiocarbamate, or mixtures thereof.

6. The process as defined in claim 1 and wherein in addition to the reducing agent is used acetic acid, chloroauric acid, hydrogen chloride, ethyl tellurac, sodium methylate, sodium dihydrogen phosphite.

7. The process as defined in claim 1 and wherein the nucleophile is dimethyl amine or thio acetamide, water, hydrogen sulfide, acetamidine, ammonia, carbon monoxide, halide ions, bisulfite ion, hydroxyl ion, carbonate ion, acetate ion; or mixtures thereof.

8. The process as defined in claim 1 and wherein the nucleophile is dimethyl amine.

9. The process as defined in claim 1 and wherein the reducing agent is thioacetic acid or thioacetamide or mixtures thereof.

10. The process as defined in claim 1 and wherein the solvent is dimethylformamide.

11. The process as defined in claim 1 and wherein the ligand is converted in said solvent in the presence of said reducing agent and said nucleophile to a sulfide of the formula $$(R_3LAu)_2S$$

wherein R is at least one of a. an alkyl group of 1 to 12 carbon atoms,
b. an alkenyl group of 1 to 7 carbon atoms,
c. an alicyclic group of 5 to 8 carbon atoms,
d. an aromatic group,
e. an alkoxy group of 1 to 7 carbon atoms,
f. an alkyl group substituted with
an alkyl amino group wherein the alkyl group is of 1 to 4 carbon atoms and is mono or di substituted on said amino group,
a cyano,
phenyl,
diphenylphosphino,
diphenylarsino;
g. phenyl substituted with
halo from 1 to 5 times,
mono aminoalkyl of 1 to 2 carbon atoms in the amino group,
mono or di alkoxy group of 1 to 4 carbon atoms,
mono or di alkyl group of 1 to 4 carbon atoms,
diphenylphosphino,
diphenylarsino;
h. alkenyl of 2 to 4 carbon atoms substituted with a phenylphosphino;
i. alkinyl of 2 to 4 carbon atoms substituted with diphenylphosphino,
j. alkyl amino of 1 to 2 carbon atoms in said dialkyl group,
k. phenoxy or tolyloxy,
l. hydrogen or halogen at least two R groups are other than hydrogen or halogen; and L is phosphino, arsino or stibino.

12. The process as defined in claim 1 and wherein the ligand is converted in said solvent, in the presence of said reducing agent and said nucleophile to the sulfide of the formula $$(R_3P\ Au)_2S$$

wherein R is at least one of a. an alkyl group of 1 to 12 carbon atoms,
b. an alkenyl group of 2 to 3 carbon atoms,
c. an alicyclic group of 6 to 8 carbon atoms,
d. a phenyl group,
e. an alkoxy group of 1 to 8 carbon atoms,
f. an alkyl group substituted with
a dialkylamino group of 1 to 2 carbon atoms in the alkylamino alkyl group,
a cyano group,
a phenyl group,
diphenylphosphino;
g. phenyl substituted with
chloro, bromo or fluoro from 1 to 5 times,
dimethylamino,
monoalkoxy group of 1 to 2 carbon atoms,
diphosphino;
h. phosphinodiphenyl,
i. dimethylamino,
j. tetraphenyl triphosphadecane,
k. phenoxy or tolyloxy,
l. hydrogen or halogen provided at least two R groups are other than hydrogen, and if P occurs more than once in the molecule, then Au may be equivalent in number to P or less than P.

13. The process as defined in claim 1 and wherein the ligand is $(C_2H_5)_3$ P Au $Cl_3$, $(C_2H_5)_3$ P Au Cl, $(C_4H_9)_3$ P Au $Cl_3$, $(n\text{-}C_4H_9)_3$ P Au SCN, $(C_6H_5)_3$ P Au Cl, $$(C_6H_5)_2-\underset{\underset{AuCl}{|}}{P}-\underset{\underset{AuCl}{|}}{P}-(C_6H_5)_2\,,$$

$(C_6H_5)_3$ P S Au Cl, $(C_6H_5)_3$ S Au $Cl_3$, $(C_6H_5)_3$ P Au S CN, $(C_6H_5)_3$ P S Au Cl, $(C_6H_5)_3$ P Au $Cl_3$, $[(C_6H_5)_3$ P $Au]_2C_2O_4$, $(C_6H_5)_3$ P Au $Br_2$ Cl, $(C_6H_5—O)_3$ P Au Cl, $(CH_3—O)_3$ P Au Cl, $(C_6H_5)_3$ As Au Cl, $(C_6H_5)_3$ P Au I, $(C_6H_5)_3$ P Au $I_3$, $(CH_3)_3$ P Au Cl, $(C_6H_5)_3$ P Au Br, $(C_6H_5)_3$ P Au Br, or $(C_6H_5)_3$ P Au $Br_3$.

14. The process as defined in claim 1 and wherein the solvent is augmented with triphenyl phosphine.

15. The process as defined in claim 1 and wherein the solvent is at 30° to 150° C.

16. The process as defined in claim 1 and wherein the solvent is N-methyl-2-pyrrolidone.

17. A process for catalyzing the deposition of a metal from a solution electrolessly, the steps comprising:

A. depositing on a substrate a complex of the formula $$(R_3L)\ (Au)X_3$$

wherein X is a halogen, a thiocyanate and a halogen, or a cyanide and a halogen; and R is a. an alkyl group of 1 to 12 carbon atoms,
b. an alkenyl group of 2 to 3 carbon atoms,
c. an alicyclic group of 6 to 8 carbon atoms,
d. a phenyl group,
e. an alkoxy group of 1 to 8 carbon atoms,
f. an alkyl group substituted with
  a dialkylamino group of 1 to 2 carbon atoms in the alkylamino alkyl group,
  a cyano group,
  a phenyl group,
  diphenylphosphino;
g. phenyl substituted with
  chloro, bromo or fluoro from 1 to 5 times,
  dimethylamino,
  monoalkoxy group of 1 to 2 carbon atoms,
  diphosphino;
h. phosphinodiphenyl,
i. dimethylamino,
j. tetraphenyl triphosphadecane,
k. phenoxy or tolyloxy,
l. hydrogen, provided at least one of R groups are other than hydrogen, and if P occurs more than once in the molecule, then Au may be equivalent in number to P or less than P;

B. exposing to UV radiation said substrate having on the surface the complex defined in A, and C. introducing the thus exposed substrate into an electroless bath having said metal therein.

18. The process as defined in claim 17 and wherein X is Cl, Br, I or mixtures thereof.

19. The process as defined in claim 17 and wherein the complex has as the R substituent thereof methyl, ethyl, propyl, butyl, phenyl, or substituted phenyl.

20. The process as defined in claim 17 and wherein said electroless metal is gold, nickel, copper, or cobalt.

21. The process as defined in claim 17 and wherein said UV exposed substrate is introduced into a bath having a palladium salt therein, said palladium salt is reduced on said UV exposed substrate and said substrate is then introduced into said electroless bath having said metal therein.

22. The process as defined in claim 17 and wherein selective areas of said substrate are exposed to said UV radiation.

23. The process as defined in claim 17 and wherein the substrate is alumina, polyimide, quartz, glass, silicon, epoxy or passivated aluminum metal.

24. The process as defined in claim 17 and wherein R is phenyl, and X is Cl.

25. The process for depositing gold by immersion plating gold on a metal comprising the steps:

dissolving in a solvent bath $R_3PAuSCN$ wherein R is alkyl of 1 to 7, phenyl, substituted phenyl, or mixtures thereof, said solvent being maintained at a temperature of 120° C and less, immersing into said bath a metal and plating gold thereon.

26. The process as defined in claim 25 and wherein the immersed metal is gold.

27. The process as defined in claim 25 wherein the solvent is dimethylformamide.

28. The process as defined in claim 25 and wherein R is phenyl.

29. A process for depositing gold on a substrate by vapor deposition, the steps comprising heating a substrate to a temperature from 300°–340° C, maintaining said substrate at said temperature and in a zone at a pressure of 2 to 3 mm of Hg, exposing said substrate to vapors of a complex of the formula $$R_3\ P\ Au\ Cl$$

wherein R is at least one of alkyl of 1 to 4 carbon atoms, alkenyl of 2 to 3 carbon atoms, phenyl, or chloro and recovering said substrate with gold from said complex deposited thereon.

30. The process as defined in claim 29 wherein R is butyl.

31. The process as defined in claim 29 wherein $R_3P$ AuCl is $(C_6H_5)\ (Cl_2)$ PAuCl.

32. The process as defined in claim 29 wherein R is allyl.

33. The process as defined in claim 29 and wherein R is phenyl.

* * * * *